United States Patent [19]

Saltz

[11] Patent Number: 4,544,051

[45] Date of Patent: Oct. 1, 1985

[54] LUGGAGE UTILIZING SERIES OF FABRIC-COVERED BATTENS

[76] Inventor: Ira M. Saltz, 341 Greenlawn Rd., Greenlawn, N.Y. 11740

[21] Appl. No.: 571,221

[22] Filed: Jan. 16, 1984

[51] Int. Cl.[4] ..... A45C 13/00; A45C 13/36

[52] U.S. Cl. ..... 190/124; 190/125; 190/126; 190/127

[58] Field of Search ..... 150/31, 130, 52 F; 190/24, 25, 28, 40, 100, 107, 122, 123–127; 383/119, 104; 206/287.1

[56] References Cited

U.S. PATENT DOCUMENTS

| | | | |
|---|---|---|---|
| 239,938 | 4/1881 | Crofford et al. | 190/100 |
| 1,040,300 | 10/1912 | Fitzgerald | 190/107 |
| 1,387,597 | 8/1921 | Fetters | 190/127 X |
| 1,513,909 | 11/1924 | Hunter | 190/127 X |
| 1,697,916 | 1/1929 | Kaufmann | 383/104 X |
| 1,712,185 | 5/1929 | Whitcomb | 190/107 X |
| 2,328,100 | 8/1943 | Ritter, Jr. | 190/125 X |
| 2,444,511 | 7/1948 | Kaufmann | 190/127 X |
| 3,071,220 | 1/1963 | O'Neil | 190/127 |

FOREIGN PATENT DOCUMENTS

| | | | |
|---|---|---|---|
| 2417109 | 10/1975 | Fed. Rep. of Germany | 383/119 |
| 720674 | 12/1931 | France | 190/40 |
| 580953 | 9/1946 | United Kingdom | 190/107 |
| 867533 | 5/1961 | United Kingdom | 190/113 |

*Primary Examiner*—William Price
*Assistant Examiner*—Sue A. Weaver
*Attorney, Agent, or Firm*—Peterson, Wicks, Nemer, & Kamrath

[57] ABSTRACT

Three luggage embodiments are disclosed. Each embodiment comprises outer and inner layers of flexible material. A series of closely adjacent parallel battens are sandwiched between the layers, there being rows of stitching between battens which form sheath-like pockets in which the battens are contained. The layers are also stitched at the ends of the battens. Handles are riveted to two battens, a zipper extending therebetween.

7 Claims, 11 Drawing Figures

LUGGAGE UTILIZING SERIES OF FABRIC-COVERED BATTENS

BACKGROUND OF THE INVENTION

This invention relates generally to the manner in which luggage is constructed, and pertains more particularly to a case or bag utilizing a series of closely adjacent parallel battens or stays with stitching therebetween.

DESCRIPTION OF THE PRIOR ART

Various stay arrangements have been used in the past for strengthening and reinforcing luggage. In most instances, the goal is to make the luggage more rigid. Consequently, the ends of the stays are either internally fastened to some part of the luggage's covering material, or the stays form an integral frame within the luggage.

Inasmuch as the patent literature is replete with a number of constructions of the types alluded to above, no need exists to catalog all of the prior art arrangements that have been patented. However, the listing of a few patents will suffice to indicate the state of the art as known to us. Five such patents are: U.S. Pat. No. 1,434,967 granted on Nov. 7, 1922 to Israel Silber for "GLADSTONE BAG"; U.S. Pat. No. 1,522,269 granted on Jan. 6, 1925 to John Recker for "TRAVELING BAG"; U.S. Pat. No. 1,572,868 granted Feb. 9, 1926 to Axelman et al for "REINFORCED SUITCASE", and U.S. Pat. No. 1,599,044 granted Sept. 7, 1926 to Daniel D. Frothingham for "HANDBAG AND METHOD OF MAKING SAME".

While the principal purpose or goal involved in connection with the above-identified patents is to strengthen them, the several patented arrangements leave rather large spans of unprotected material between the various reinforcing strips or stays. Consequently, relatively thick and heavyweight covering material is utilized in an effort to reduce the effect of exterior forces that would unduly deform thinner material. Even so, any item contained within the bag is not completely protected because of the expanse of unsupported covering material that exists between the strips or stays.

SUMMARY OF THE INVENTION

Inasmuch as the current fashion trend is in the direction of soft-sided luggage, one object of my invention is to preserve a soft-sided appearance, yet protect the contents of the luggage, even when the luggage is subjected to careless handling and transported under adverse conditions beneath piles of other luggage. In this regard, when utilizing a series of closely spaced parallel battens contained in sheath-like pockets formed between the outer and inner covering material, as done when following the teachings of my invention, there can be considerable flexibility in that the various battens are free to pivot or angle relative to each other, yet this arrangement affords adequate protection for the items inside, as well as keeping the clothing within the bag wrinkle free. Stated somewhat differently, an aim of the invention is to provide luggage that generally includes attributes of both rigid shell luggage and soft-sided luggage.

Closely associated with the above object is the additional object of employing battens formed with different profiles so as to impart various degrees of structural support to the bag in accordance with the type of service that the bag is expected to be subjected to. More specifically, relatively thick battens can be used in some cases and quite light battens can be used in others. Still further, it is contemplated that the battens can be formed from different materials such as plastics, metals and rubber.

Another object is to provide a luggage case or bag that is rugged, yet quite light in weight. In this regard, it is within the purview of my invention to utilize hollow, more specifically tubular, battens, thereby further decreasing the overall weight of the luggage and at the same time increasing its strength, as compared to battens having a solid cross section.

Still further, an object of the invention is to provide luggage of the foregoing character that will retain its shape. More specifically, it is within the scope of the invention to employ relatively rigid battens that render the luggage sufficiently rigid so that it will stand up without external support, and on the other hand utilize relatively flexible battens that enable the luggage to be collapsed and rolled up. In other words, it is planned that the manufacturer have a rather wide choice as to the structural characteristic to be imparted to the luggage being fabricated, doing so merely by selecting the type of batten.

Yet another object of the invention is to provide luggage that can be fabricated rather inexpensively. In this regard, since the battens can be formed from different materials, it is planned that the battens be extruded, stamped or die cut, whichever procedure is most suitable for the particular material being utilized. Generally, it is planned that the battens be of plastic, such as ABS plastic.

While it is important for luggage to be rugged and serviceable under a variety of handling and traveling conditions, the user normally wants a bag that is attractive as well as serviceable. Therefore, an additional object of my invention is to provide a bag that is aesthetically pleasing. In this regard, it can be pointed out that the use of the large number of battens, the various battens being oriented in a parallel relationship with respect to each other, form what might be best described as a tambour-like appearance.

It is also an additional object of my invention to vary the sizes and configuration of the battens, permitting, say, battens of alternating width. This not only enhances the appearance in some cases, but can be used to accomplish certain mechanical functions, all depending upon the style of case.

Still further, an object of my invention is to provide luggage utilizing the series of battens referred to above that lends itself readily to employing both attractive trimming and handles. Also, luggage constructed in accordance with the teachings of my invention permits zippers to be inconspicuously employed in that they can run in the same direction as the battens and stitching.

Another object of the invention is to provide a batten construction that lends itself readily to being incorporated in different types of luggage. In this regard, it is an aim of the invention to permit the features thereof to be embodied in large and small pullman luggage, a duffel bag type, or a garment bag type.

Briefly, my invention envisages the use of outer and inner layers of flexible sheet material, such as packcloth nylon, containing therebetween a series of battens or stays which are closely adjacent to each other. By means of rows of stitching, there being one row between each two battens, the layers of covering material are pulled into engagement or contact with each other so as to encase the various battens in a sheath-like manner. Additional stitching can be employed at the ends of the battens. In this instance, the stitching adjacent the ends of the batten is also employed to anchor a marginal portion of a double layer of leather trim. Whereas the marginal edges of the two layers of trim are stitched together, there remains an additional margin spaced from the margin that is stitched to close the ends of the sheath-like pockets, the additional margin being free for use as far as attaching the sheet material that is to constitute the ends of the case. Various structural results are achieved by simply utilizing battens of different cross sections and/or materials. Still further, the use of battens enables attractive handles to be secured directly to portions of those battens in the region where handles are to be used. Also, it is planned that a zipper extend parallel to the direction in which the battens extend, the zipper thereby blending into the overall appearance of the luggage case and becoming relatively inconspicuous.

BRIEF DESCRIPTION OF THE DRAWINGS

FIG. 1 is a perspective view of luggage in the form of a pullman case embodying my invention;

DESCRIPTION OF THE PREFERRED EMBODIMENTS

Figure 2:
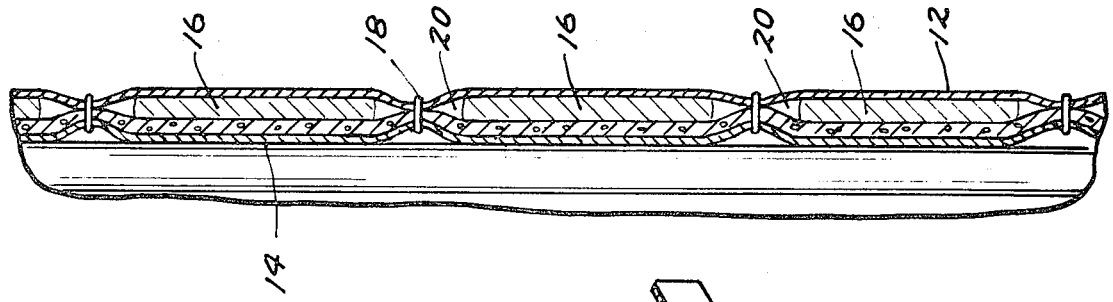
FIG. 2 is a sectional view taken in the direction of line 2—2 of FIG. 1, the view showing the pocket-like containment of several battens.

In FIG. 1, one embodiment of my invention is depicted, the luggage being in the form of a pullman case denoted generally by the reference numeral 10. The case 10 comprises an outer layer 12 of flexible sheet material, such as packcloth nylon which has been Teflon treated for water and stain resistance. The pullman case 10 also includes an inner layer 14 of flexible sheet material which can also be of various types. It is contemplated that the inner material 14 be also of nylon, but perhaps of a different color than the layer 12. As with both the inner and outer layers 12 and 14, respectively, the materials can be selected in accordance with the quality, service and the desires of the type of person who is apt to purchase the luggage.

Figure 3:
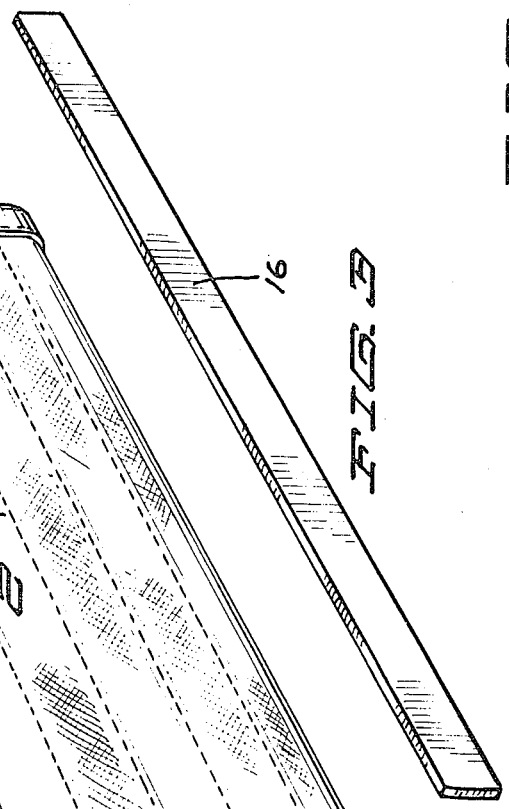
FIG. 3 is a perspective view of a single batten prior to its installation in luggage case pictured in FIG. 1.
Figure 7:
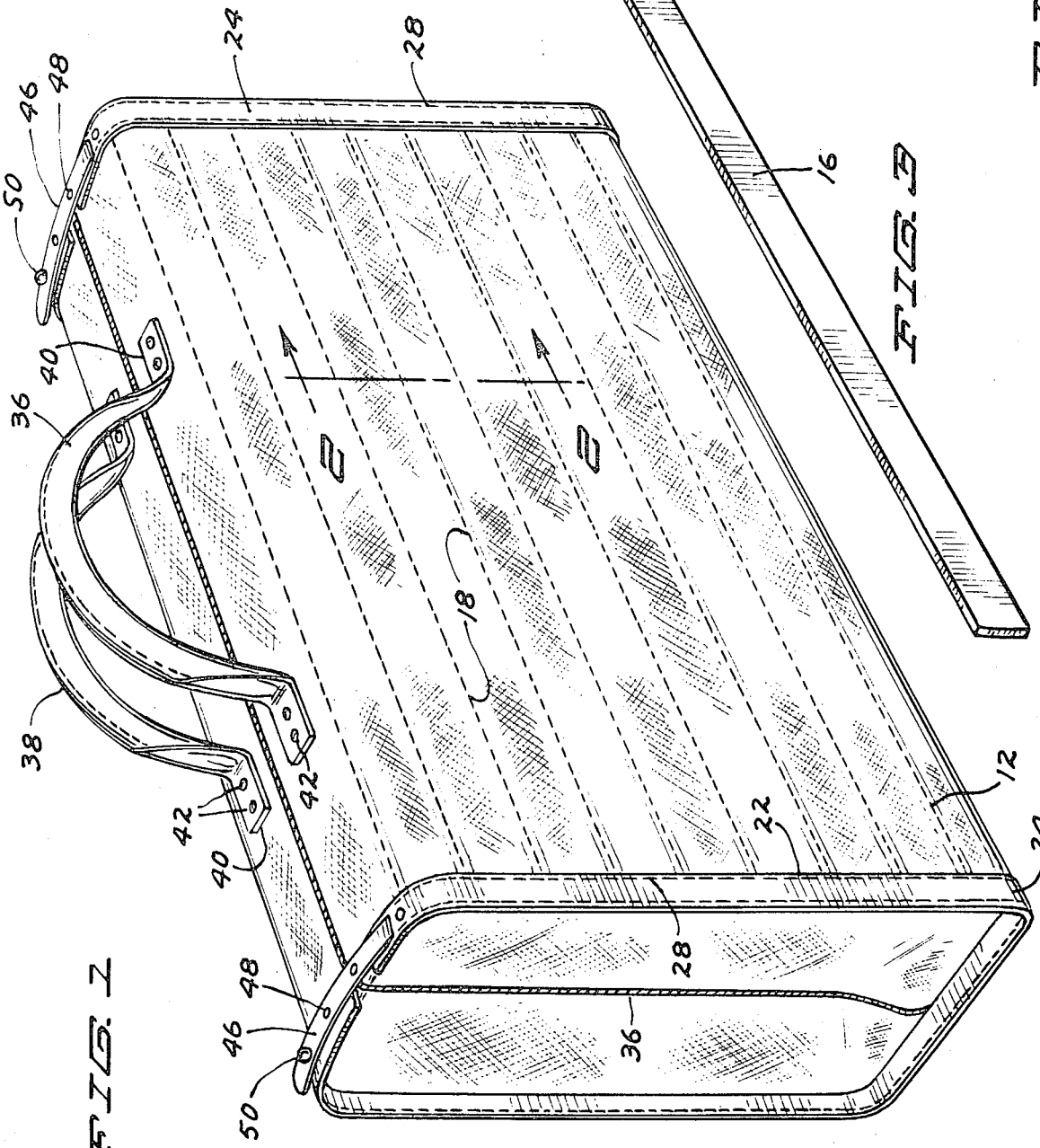
FIG. 7 is a sectional view taken at one end of the case, the view being taken in the direction of line 7—7 of FIG. 4 for the purpose of showing how one end of the sheath-like pocket is closed by means of transverse stitching and also how the material constituting the end of the case is stitched to one margin of the double layer trim.

Playing an important role in the practicing of my invention is a series of battens or stays 16 which are sandwiched between the outer and inner layers 14, as can be discerned from FIG. 2. Here again, the battens 16 can be fabricated with different cross sections and/or from different types of material, depending to a large degree on the type of service to which the luggage case 10 is to be put. For instance, the battens 16 may possess a solid cross section, as readily discernible from FIGS. 2 and 3, or the battens can have a tubular cross section (not illustrated). When quite thin and resilient, the battens 16 permit the ends of the pullman case 10 to be pushed toward each other, so that when so collapsed the case 10, when empty, can be readily rolled up for storage or more convenient carrying when not needed. It is also planned that the battens 16 be of plastic, metal or rubber, or even a combination of such materials. Furthermore, such materials can be readily extruded, stamped or die cut.

As far as a specific plastic material for the battens 16 is concerned, ABS has proved quite satisfactory when possessing a width of 3.5 centimeters and a thickness of 0.5 centimeter. Of course, the length is determined by the length of the luggage case 10; a practical length is 50 centimeters. With the dimensions just given, it is planned that the battens or strips 16 be initially spaced approximately 0.5 centimeter from each other, thereby placing the battens 16 in close adjacency. Of course, as will be better understood below, the spacing between adjacent battens 16 will depend upon their thickness and to some degree the type of flexible covering material 12 and the inner lining material 14, these parameters being susceptible to variation depending upon styling and the contemplated service.

At this time, attention is directed to the various longitudinal rows of stitching labeled 18. The stitching 18 is instrumental in pulling the confronting surfaces of the layers 12 and 14 together to form sheath-like pockets 20 which contain therein the various battens 16.

It is intended that end stitching 22 also be employed. Each batten 16 is, therefore, fully encased because there are two rows of stitching 18 extending parallel thereto and two end rows of stitching 22 extending transversely thereto.

One of the niceties of my inventions is that leather belting can be used to trim the case 10. In this situation two strips 24, 26 of appropriately colored leather are made use of which are stitched together at 28. The previously mentioned stitching 22 passes through one margin of the strip 24 of the double-stripped belting, whereas additional stitching 30 passes through the remaining margin of the strip 26. Without going into any great detail, especially inasmuch as it does not directly constitute a part of my invention, it is to be observed that the last-mentioned stitching 30 is instrumental in anchoring the material 32 that is to constitute the ends of the luggage case 10.

Largely for the sake of completeness, it will be observed that a zipper 34 extends upwardly from the bottom at one end of the case 10 and then goes across the top and then down the other end to the bottom. The zipper 34 is relatively inconspicuous in that it is parallel to the rows of stitching 18.

Figure 4:
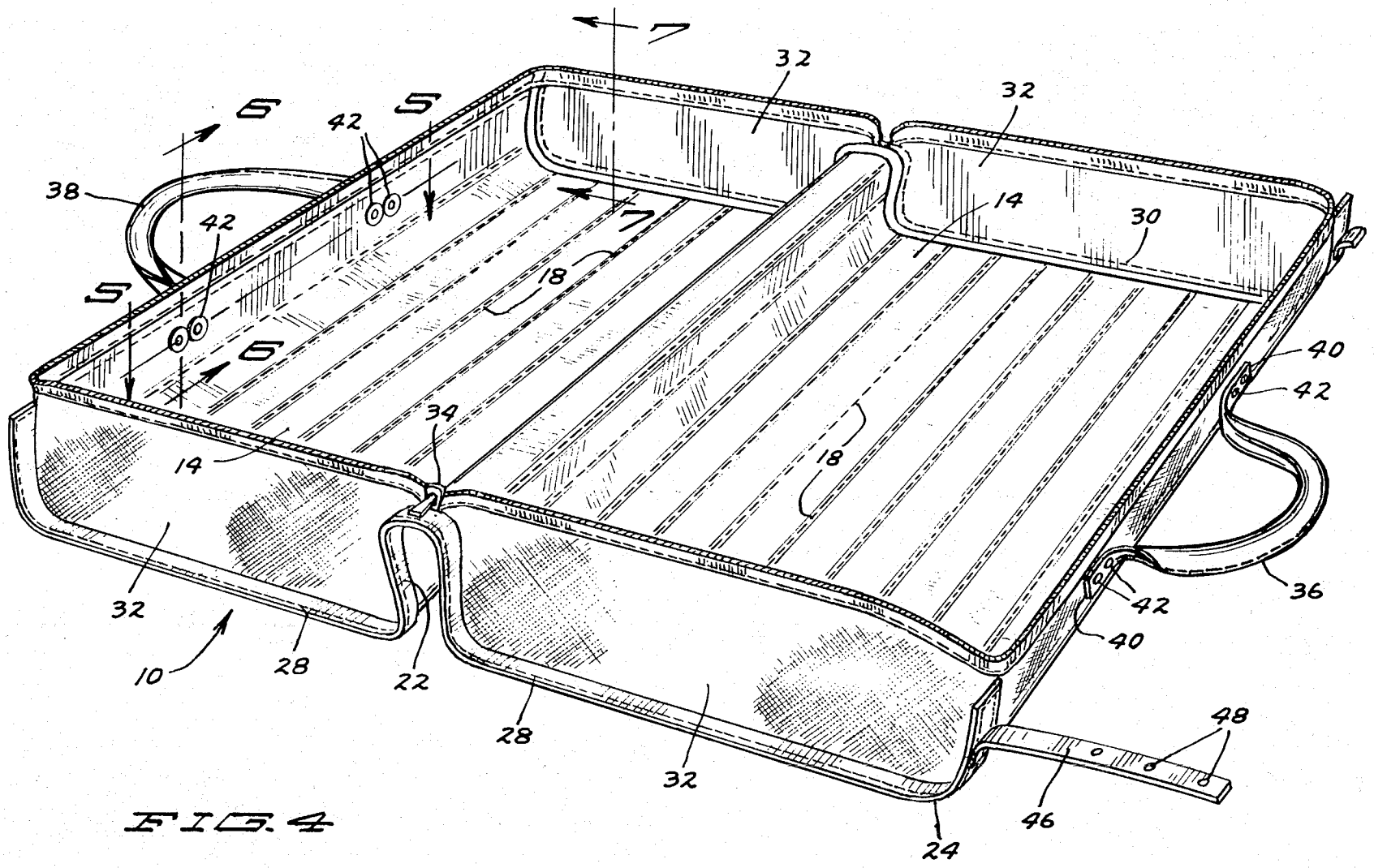
FIG. 4 is a perspective view of the pullman case in an open position.
Figure 5:
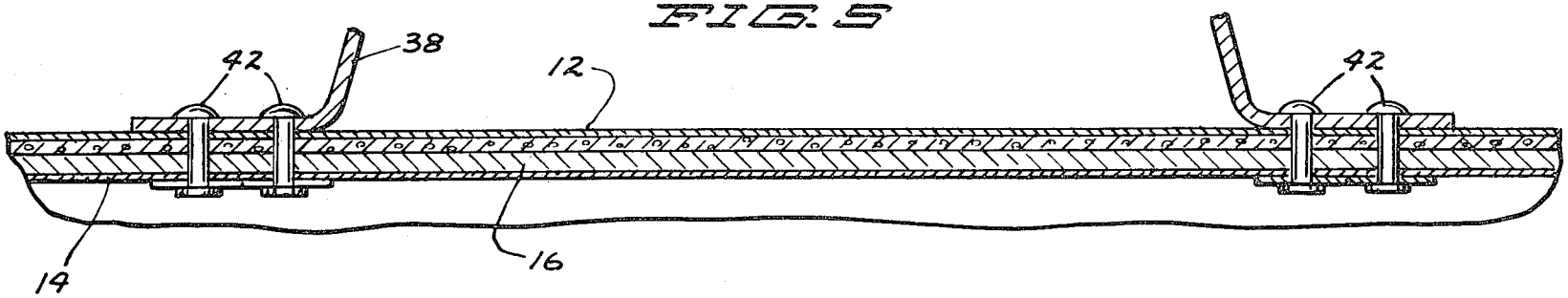
FIG. 5 is a longitudinal detail sectional view taken in the direction of line 5—5 of FIG. 4.
Figure 7:
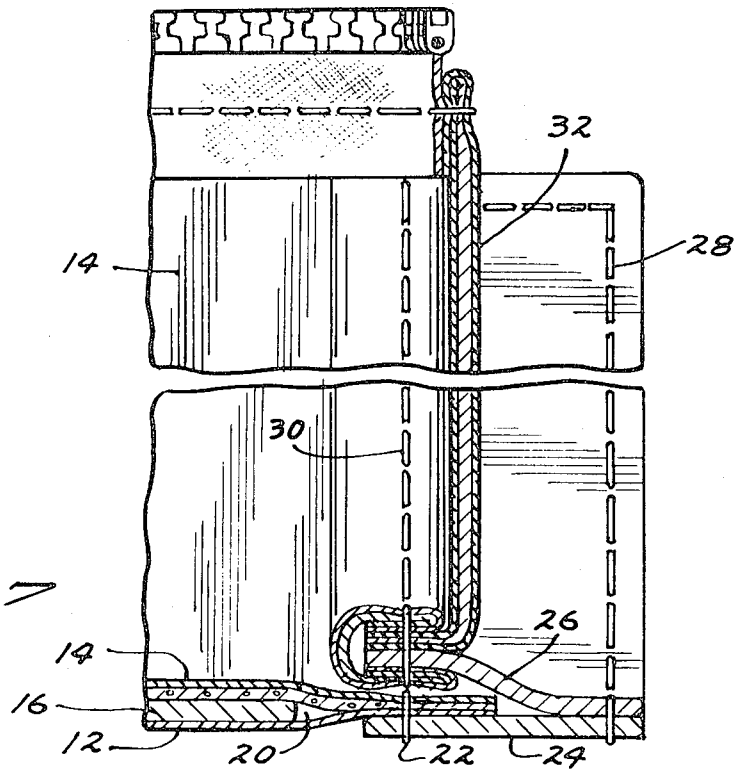
Figure 6:
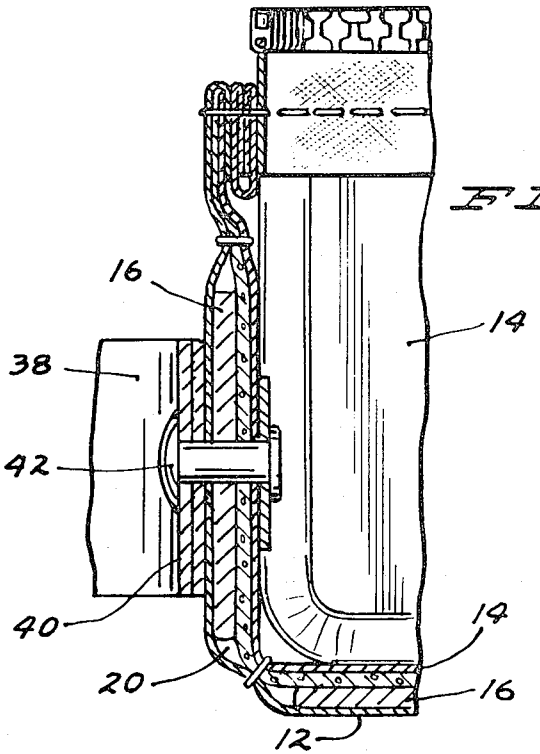
FIG. 6 is a transverse sectional view taken in the direction of line 6—6 of FIG. 5.
Figure 9:
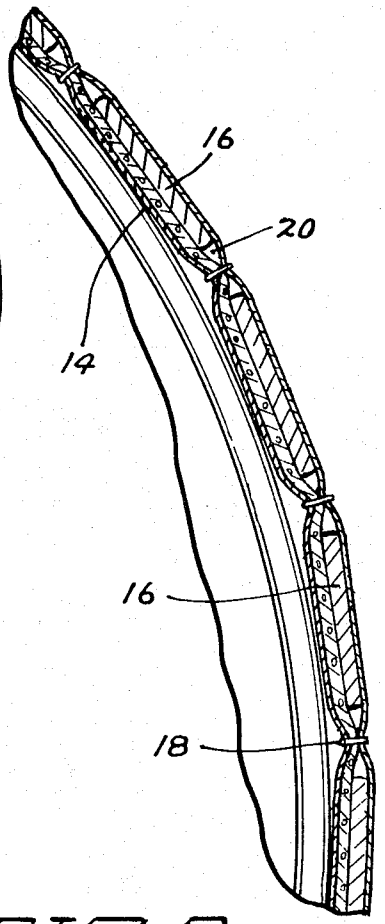
FIG. 9 is a sectional view taken in the direction of line 9—9 of FIG. 8, the view corresponding generally to FIG. 2 for the purpose of demonstrating the similarity between the case of FIG. 1 and the bag of FIG. 8.

One feature of my invention that should be dealt with is the facility with which attractive handles can be attached. Accordingly, leather handles 36 and 38 are depicted. Each handle 36, 38 has oppositely issuing anchor tabs 40. It is through the agency of the tabs 40 that four rivets 42 fasten the tabs 40 and the handle 36 integral therewith to the particular batten 16 at the top of the luggage case 10. This feature is best understood from FIGS. 4 and 5. It will be appreciated that the two battens 16, as far as the handles 36, 38 are concerned, function as anchor plates without utilizing any additional mounting material.

It will also be observed that a pair of flexible end straps 46, preferably of leather, have several holes 48 therein. By means of a snap fastener stud 50 that can be attached to the previously mentioned double-stripped trim or belting 24, 26 possesses a head that can be pressed through any selected hole 48 in the end straps 46.

Figure 8:
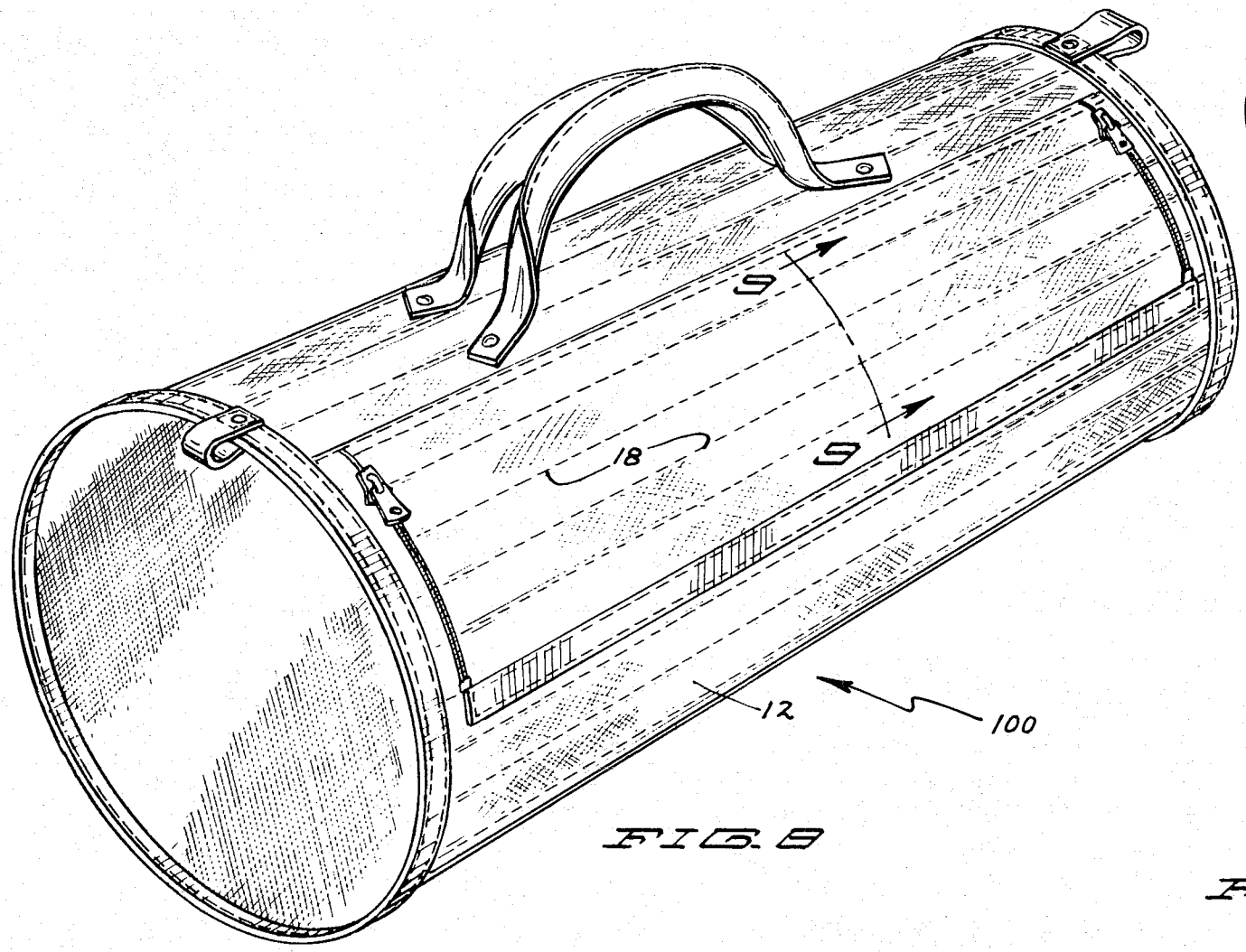
FIG. 8 is a perspective view of a duffel bag utilizing the teachings of my invention.
Figure 10:
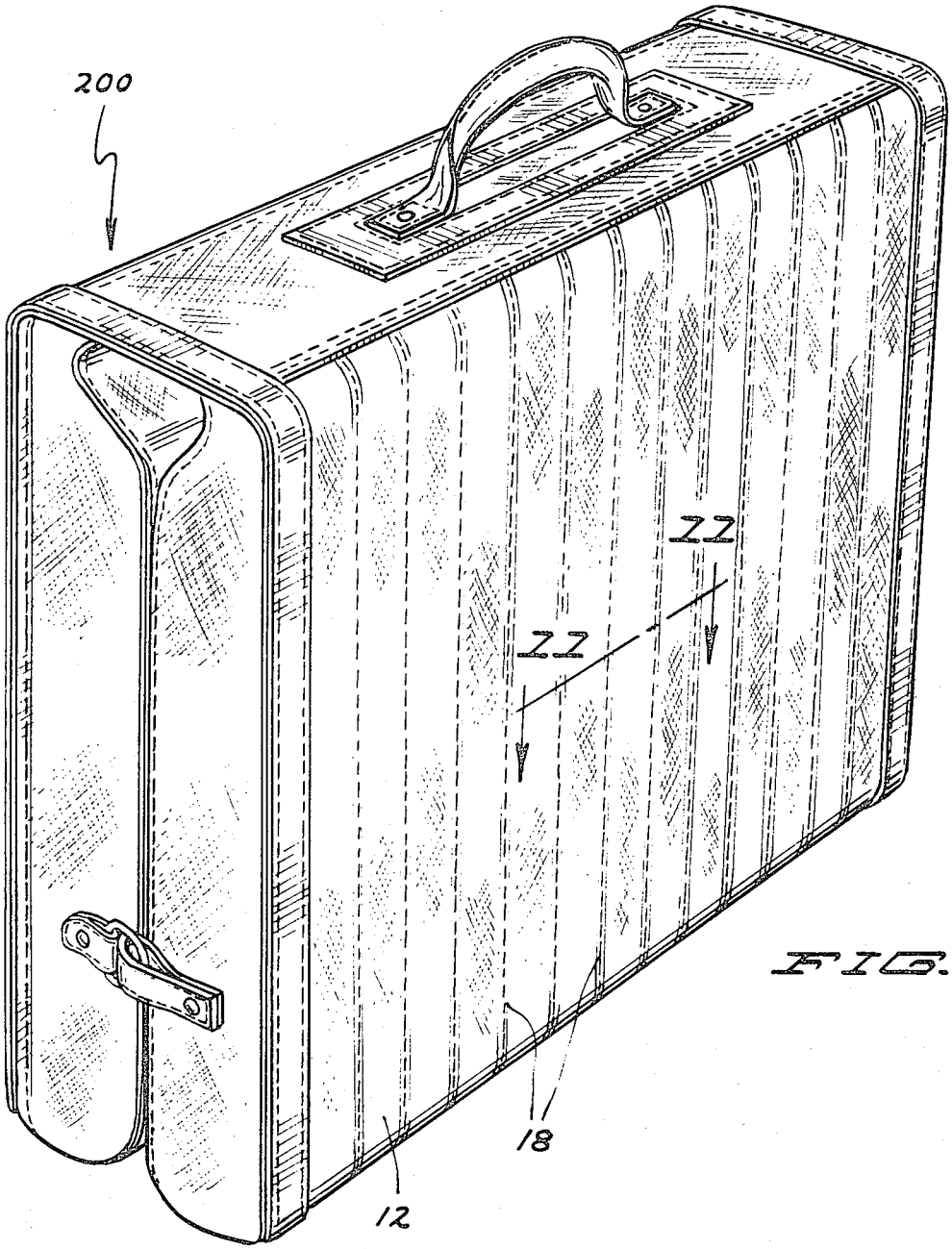
FIG. 10 is a perspective view of a garment bag utilizing my invention.
Figure 11:
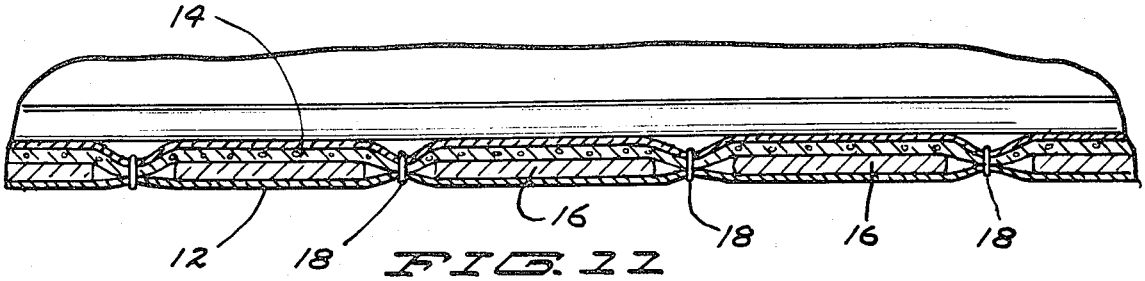
FIG. 11 is a sectional view taken in the direction of line 11—11 of FIG. 10, the view illustrating the construction similarity between the pullman case, the duffel bag and the garment bag.

Largely to show the versatility of my invention as far as incorporating it into other types of luggage, reference will now be briefly made to FIGS. 8 and 10. It is believed only necessary to assign the duffel bag of FIG. 8 the reference numeral 100. Constructionally speaking, it is very similar to the bag 10. It is thought that this is demonstrated by the cross section taken in the direction of line 9—9 of FIG. 8 which corresponds to the structure revealed by the construction shown in FIG. 2.

The same thing can be said for FIG. 10 wherein the garment bag utilizing the teachings of my invention has been denoted generally by the reference numeral 200. Here again, the directional line 10—10 has been applied to FIG. 10 to demonstrate that the cross sectional makeup of portions of the garment bag 200 is the same as that of the luggage case 10 appearing in FIG. 1, this being by reason that FIG. 2 illustrates the same structural arrangement that is present in the garment bag 200 as in the pullman case 10 and the duffel bag 100. Garment bags normally are incapable of standing up by themselves. However, when utilizing the battens 16, the garment bag 200 will stand up, as depicted in FIG. 10, without any external support, an exceptionally desirable feature.

Quite obviously, the pullman case 10, the duffel bag 100 and the garment bag 200 can differ in details. This is so by virtue of the different types of service to be expected from the three exemplary types of luggage that have been herein presented. However, the manner in which the battens 16 are employed is the same for all three luggage embodiments 10, 100 and 200.

From the foregoing, it should be evident that the adjacent battens 16 can be flexed or angled with respect to each other. Whereas they are contained in sheath-like pockets 20, the stitching 18 serves as a longitudinal pivot line about which the flexing of the adjacent battens 16 can readily take place. Thus, while the overall effect is to provide luggage that has a soft-side appearance, more specifically a tambour-like one, it should be recognized that the series of battens 16, owing to their close proximity with each other, provide a shell-like result that admirably protects the contents transported within the luggage case 10 from otherwise damaging exterior blows. In other words, my invention combines the advantages of both hard shell and soft-side luggage into a single piece of luggage.

Consequently, it is believed readily apparent that I have devised luggage that is not only serviceable in that the items carried therein are adequately protected, but the overall appearance of the luggage is aesthetically pleasing.

I claim:

1. A luggage case or bag comprising outer and inner layers of flexible sheet material, a series of closely spaced parallel battens sandwiched between said layers, rows of stitching passing through said outer and inner layers in the spacing between adjacent battens to pull said outer and inner layers together along lines extending in said spacing between adjacent battens to form sheath-like pockets, each pocket containing a batten therein, whereby said battens can pivot or angle relative to each other along the particular row of stitching therebetween, belting at the ends of the luggage, and additional stitching passing through the inner and outer layers of flexible sheet material at the ends of said battens, said additional stitching also passing through a marginal portion of said belting.

2. Luggage in accordance with claim 1 in which said belting includes two strips, said additional stitching passing through the marginal portion of only one of said strips.

3. Luggage in accordance with claim 2 in which the opposite marginal portions of the belting are stitched together.

4. Luggage in accordance with claim 3 in which there is flexible material at the ends of the luggage and still additional stitching passing through the margin of the second strip and said end material.

5. Luggage in accordance with claim 1 in which the initial spacing of said battens is approximately 0.5 centimeter.

6. Luggage in accordance with claim 1 in which said battens are resilient.

7. Luggage in accordance with claim 1 in which said outer and inner layers of flexible sheet material and said battens constitute the entire opposite sides of the luggage.

* * * * *